US008651343B2

(12) United States Patent
Huang

(10) Patent No.: US 8,651,343 B2
(45) Date of Patent: Feb. 18, 2014

(54) SUSPENSORY LIFTING APPARATUS FOR LEAD SUITS IN RADIATION THERAPY

(76) Inventor: Shi-Jie Huang, Taichung (TW)

( * ) Notice: Subject to any disclaimer, the term of this patent is extended or adjusted under 35 U.S.C. 154(b) by 334 days.

(21) Appl. No.: 13/102,022

(22) Filed: May 5, 2011

(65) Prior Publication Data

US 2012/0280004 A1 Nov. 8, 2012

(51) Int. Cl.
*A41D 27/22* (2006.01)

(52) U.S. Cl.
USPC ..... 223/85; 223/92; 250/516.1

(58) Field of Classification Search
USPC ..... 250/516.1; 223/88, 98, 85, 92
See application file for complete search history.

(56) References Cited

U.S. PATENT DOCUMENTS

| | | | | |
|---|---|---|---|---|
| 4,254,341 | A * | 3/1981 | Herr et al. | 250/519.1 |
| 5,015,864 | A * | 5/1991 | Maleki | 250/516.1 |
| 5,603,438 | A * | 2/1997 | Jugan | 223/85 |
| 5,704,881 | A * | 1/1998 | Dudley | 482/69 |
| 6,454,145 | B1 * | 9/2002 | Russ | 223/85 |
| 2007/0138415 | A1 * | 6/2007 | Rees | 250/516.1 |
| 2009/0184269 | A1 * | 7/2009 | Rees | 250/516.1 |
| 2009/0256044 | A1 * | 10/2009 | Miller et al. | 248/317 |
| 2010/0107320 | A1 * | 5/2010 | Rees | 250/516.1 |
| 2011/0174997 | A1 * | 7/2011 | Rees | 250/516.1 |

FOREIGN PATENT DOCUMENTS

| | | | |
|---|---|---|---|
| WO | WO 9842258 A1 * | 10/1998 | A61B 6/10 |

* cited by examiner

*Primary Examiner* — Nathan Durham

(57) ABSTRACT

A suspensory lifting apparatus for lead suits in radiation therapy is an apparatus to suspend a lead suit for radiation therapists. A radiation therapist puts on the lead suit under the apparatus. A load of the lead suit imposing on the therapist is reduced by the apparatus. Thus, a radiation therapist is able to take actions comfortably as far as the mechanical arm's reach of the apparatus.

3 Claims, 4 Drawing Sheets

SUSPENSORY LIFTING APPARATUS FOR LEAD SUITS IN RADIATION THERAPY

BACKGROUND OF THE INVENTION

1. Field of the Invention

The present invention relates to an apparatus to suspend a lead suit more particularly to a suspensory lifting apparatus for lead suits in radiation therapy which makes a radiation therapist comfortable during a radiation therapy.

2. Description of Related Art

Radiation therapy is a necessary therapy for modern medical treatment. For example, radiation therapy is used for a treatment of malignant cancer. In addition, radiation therapy is common to combine with surgery, chemotherapy, hormone therapy, and immunotherapy. However, radiations are also harmful for human bodies so that radiation therapists are wearing lead suits conventionally to protect themselves during the treatments. Generally, the weight of the lead suits is around eight to twelve kilograms. Thus, it is not convenient and comfortable for radiation therapists when they are wearing lead suits to take care of patients. Moreover, if radiation therapists wore lead suits for a long period of time, their shoulders and waists would get hurt easily and become an occupational injury gradually.

In order to make radiation therapists feel more convenient and more comfortable to treat patients for a long period of time, a suspensory lifting apparatus for lead suits is designed. The present invention is an apparatus for lead suits suspending. The load from the lead suits can be reduced by the present invention so that radiation therapists are able to treat patients efficiently under the present invention.

The present invention has arisen to mitigate and/or obviate the disadvantages of the conventional.

SUMMARY OF THE INVENTION

The main objective of the present invention is to provide an improved apparatus to suspend a lead suit.

To achieve the objective, a suspensory lifting load apparatus for lead suits in radiation therapy comprises a suit hanger, a bracket adapted to fix at a ceiling, a steel beam or a wall, a mechanical arm set assembled by a plurality of minor arms, wherein each minor arm pivoted by other minor arm from one end to another end, one end of the mechanical arm set pivoted at the bracket and another end pivoted at the suit hanger, a lead suit hung on the suit hanger, a therapist putting on the lead suit at the suit hanger and a therapist being able to take actions as far as the mechanical arm's reach, a load of the lead suit imposing on the therapist reduced by the suit hanger.

The suit hanger comprises two supporting rods corresponding to the therapist's shoulders, a U-rod surrounding the therapist's head for connecting the two supporting rods.

The suspensory lifting apparatus for lead suits in radiation therapy further comprises an adjustable portion disposed between the mechanical arm set and the suit hanger, the adjustable portion comprising an axial rod pivoted at the mechanical arm set, a pipe pivoted at the top of the U-rod, the axial rod being able to move up and down in the pipe, a plurality of positioning holes opened on the pipe corresponding to the positioning holes opened at the axial rod, the adjustable portion having a positioning pin to be inserted into the positioning holes selectively and to control a relative length from the pipe to the axial rod.

The supporting rod has a locking portion, the locking portion formed by bending up the end of the supporting rod.

The supporting rod has a shoulder protection for cushioning a load on the therapist's shoulders.

The suspensory lifting apparatus for lead suits in radiation therapy further comprises a lead glass mask set provided to protect the therapist's face from a patient's blood, the lead glass mask set having two tracks at two line portions of the U-rod respectively and a lead glass mask, wherein the two sides of the lead glass mask are able to slide and lock at the two tracks respectively.

Further benefits and advantages of the present invention will become apparent after a careful reading of the detailed description with appropriate reference to the accompanying drawings.

DETAILED DESCRIPTION OF THE INVENTION

Figure 1:
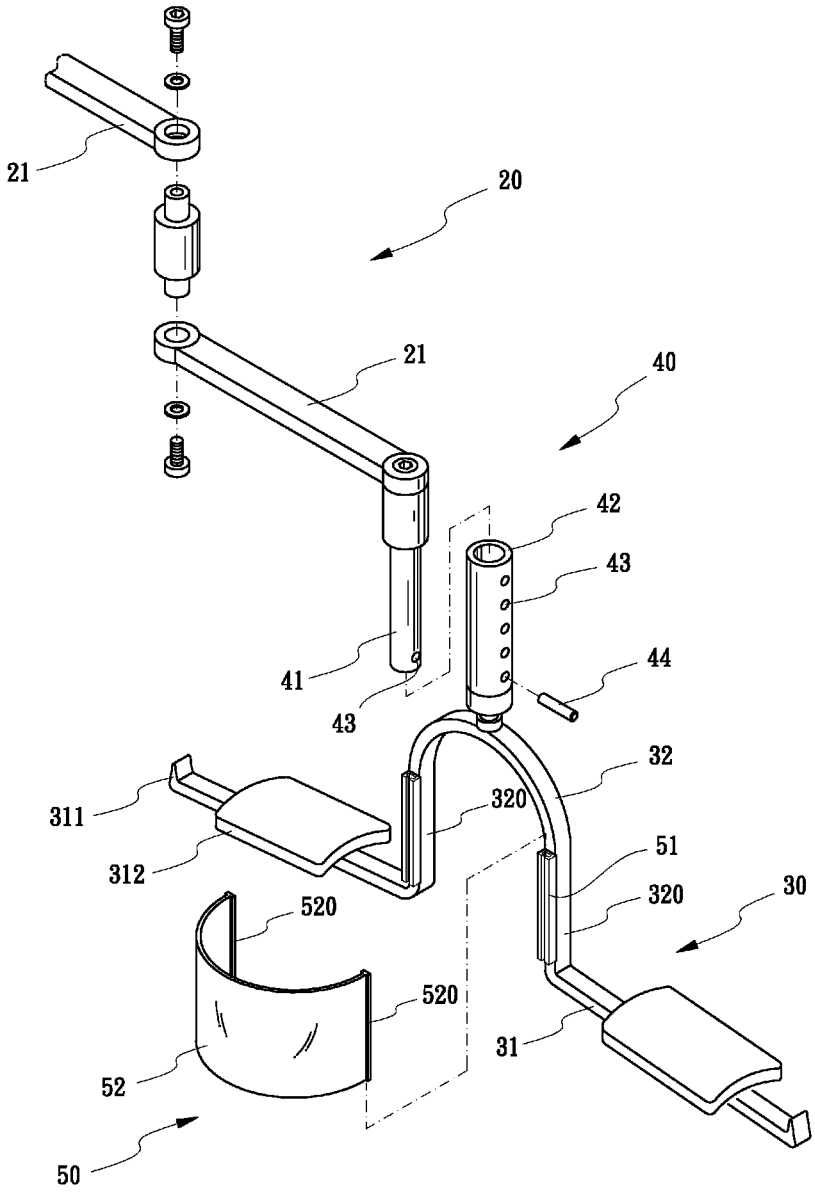
FIG. 1 is a partial exploded view of a suspensory lifting apparatus for lead suits in radiation therapy of the present invention.

Referring to the drawings to FIGS. 1-4, a suspensory lifting apparatus for lead suits in radiation therapy in accordance with the present invention comprises a bracket 10, a mechanical arm set 20, and a suit hanger 30.

The bracket 10 is adapted to be fixed at a ceiling, a steel beam, or a wall. The mechanical arm set 20 is assembled by a plurality of minor arms 21, wherein each minor arm is pivoted by other minor arm from one end to another end. One end of the mechanical arm set is pivoted at the bracket 10 and another end is pivoted at the suit hanger 30.

A lead suit 60 is hung on the suit hanger 30. A therapist puts on the lead suit 60 at the suit hanger 30 and a therapist is able to take actions as far as the mechanical arm's 20 reach. A load of the lead suit 60 imposing on the therapist is reduced by the suit hanger 30.

The suit hanger 30 comprises two supporting rods 31 corresponding to the therapist's shoulders, and a U-rod 32 surrounding the therapist's head for connecting the two supporting rods 31.

The suspensory lifting apparatus for lead suits in radiation therapy further comprises an adjustable portion 40 disposed between the mechanical arm set 20 and the suit hanger 30. The adjustable portion 40 comprises an axial rod 41 pivoted at the mechanical arm set 20, a pipe 42 pivoted at the top of the U-rod 32. The axial rod 41 is able to move up and down in the pipe 42. A plurality of positioning holes 43 are opened on the pipe 42 corresponding to the positioning holes 43 opened at the axial rod 41. The adjustable portion 40 also has a positioning pin 44 to be inserted into the positioning holes 43 selectively and to control a relative length from the pipe 42 to the axial rod 41. Consequently, the height of the suit hanger 30 is adjusted by adjusting the relative length from the pipe 42 to the axial rod 41 to fit each therapist with different height.

The supporting rod 31 has a locking portion 311, wherein the locking portion 311 is formed by bending up the end of the supporting rod 31. Therefore, the lead suit 60 is stably hung on the suit hanger 30 instead of falling off during the therapist's work.

The supporting rod 31 has a shoulder protection 312 so that the lead suit 60 is spread by the shoulder protection 312 and the lead suit 60 does not impose on the shoulder directly.

Figure 2:
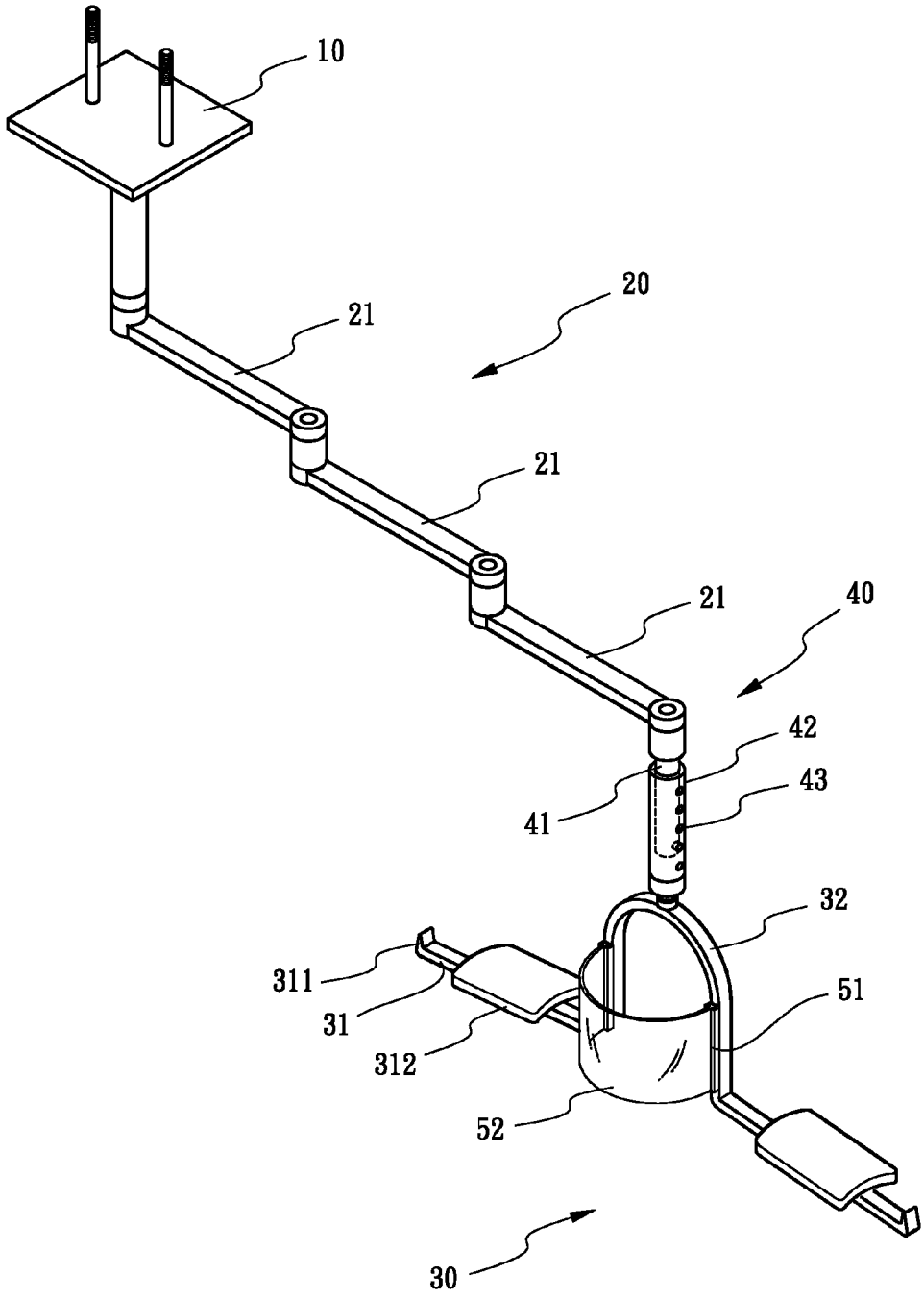
FIG. 2 is an assembled view of the suspensory lifting apparatus for lead suits in radiation therapy of the present invention.
Figure 3:
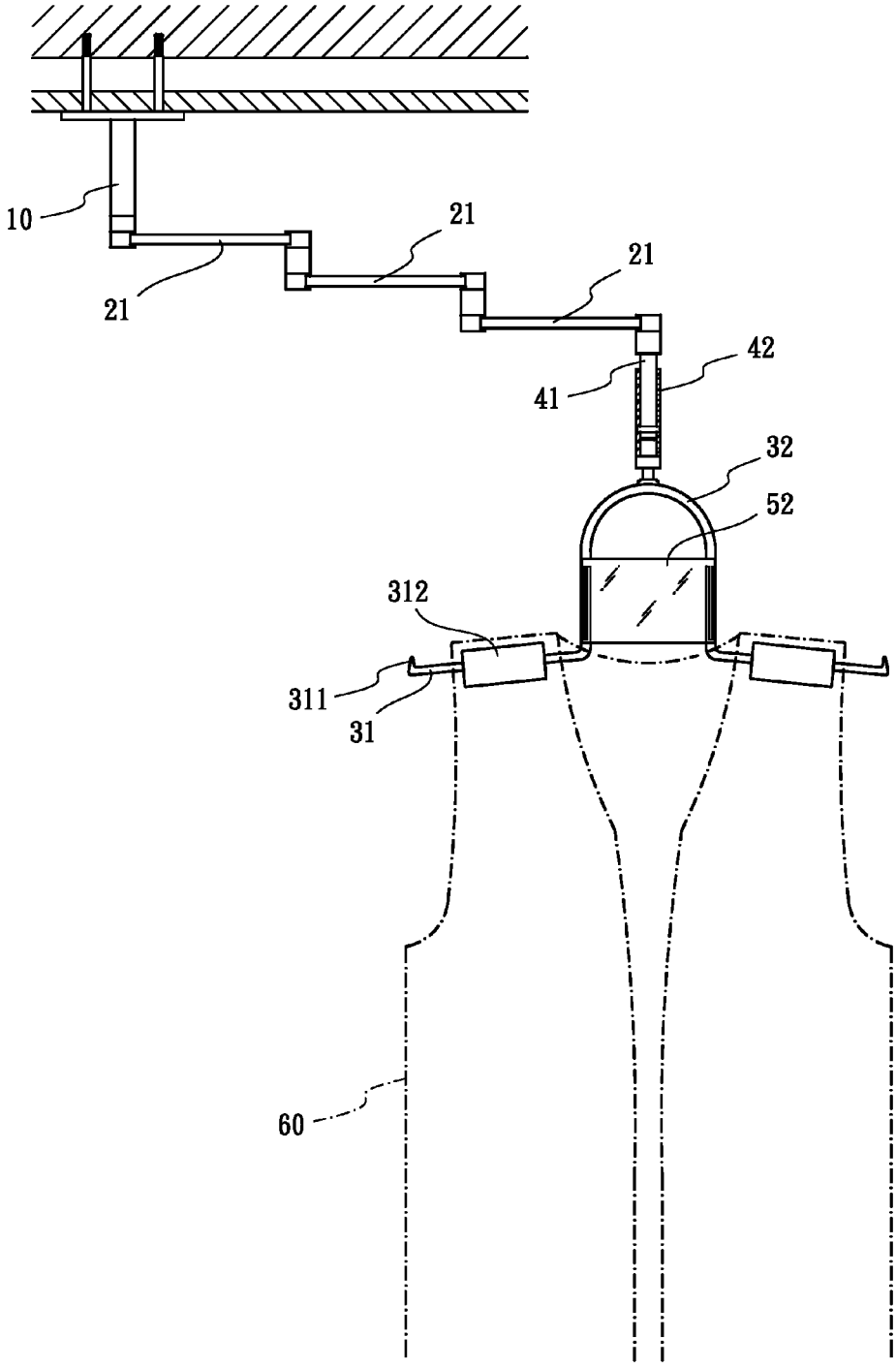
FIG. 3 is an assembled view for showing a lead suit hung on the present invention.
Figure 4:
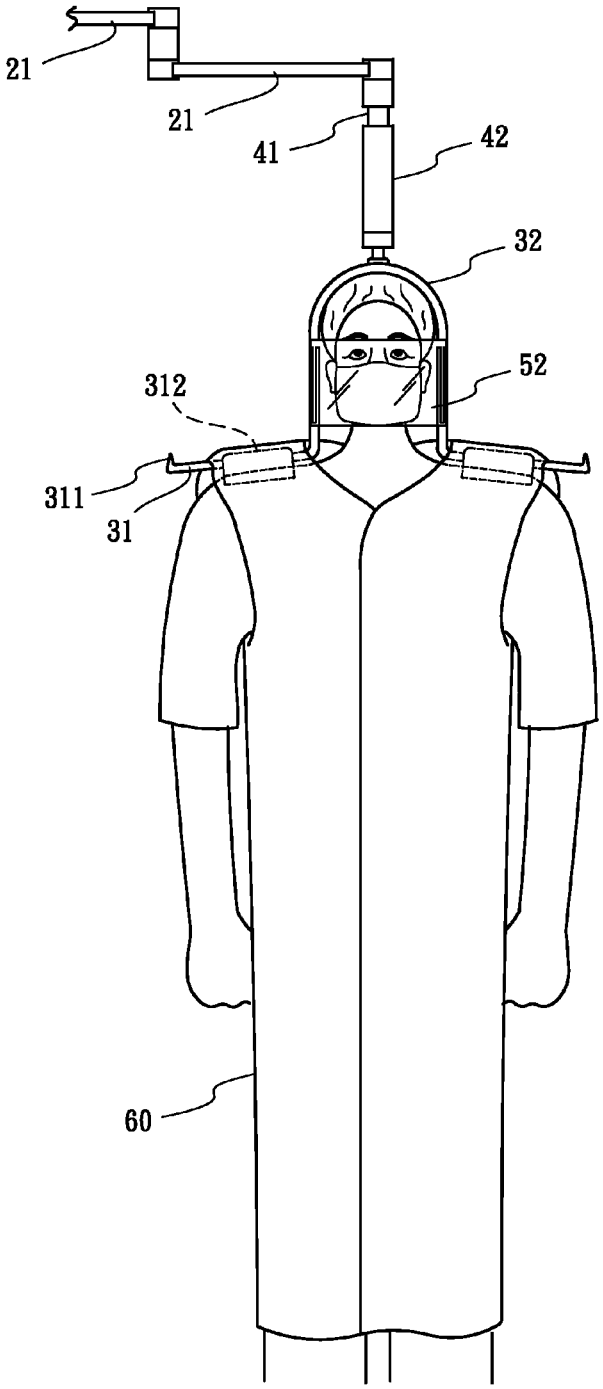
FIG. 4 is an assembled view for showing a therapist putting on the lead suit hung in the present invention.

The suspensory lifting apparatus for lead suits in radiation therapy further comprises a lead glass mask set 50 provided to protect the therapist's face from a patient's blood. The lead glass mask set 50 has two dovetail tracks 51 at two legs (320) of the U-rod 32 respectively and a lead glass mask 52 with a U-shaped cross section, as best seen in FIG. 1, to protect the therapist's face, wherein the two sides of the lead glass mask 51 are able to slide and lock at the two tracks respectively. Specifically, the lead glass mask has at opposite ends two male dovetail bars 520 (see FIG. 1) detachably interlocked with the two dovetail tracks on the U-rod of the suit hanger respectively, as depicted in FIG. 2.

Although the invention has been explained in relation to its preferred embodiment, it is to be understood that many other possible modifications and variations can be made without departing from the spirit and scope of the invention as hereinafter claimed.

What is claimed is:

1. A suspension apparatus for holding a lead suit in radiation therapy comprising:

a suit hanger for supporting the lead suit;

a bracket to be fixed at a ceiling, a steel beam, or a wall;

a mechanical arm set including a plurality of minor arms pivotally connected to one another in series, one end of the mechanical arm set is pivoted at the bracket and another end pivoted to the suit hanger;

an adjustable portion connecting the mechanical arm set and the suit hanger, and comprising an axial rod, a pipe telescopically connected to the axial rod, and a positioning pin; wherein the axial rod defines a positioning hole in a side thereof; the pipe defines a plurality of holes axially arranged in a row; and the positioning pin is inserted in a selected one of the holes of the pipe as well as the positioning hole of the axial rod; and a lead glass mask set provided to protect a face of an operator, wherein the suit hanger includes a U-rod configured to embrace a head of the operator, and two supporting rods laterally extending from two legs of the U-rod to be suspended over a pair of shoulders of the operator; the lead glass mask set includes two dovetail tracks disposed on the two legs of the U-rod respectively and a lead glass mask with a U-shaped cross section to shield the face of the operator, wherein the lead glass mask has at opposite ends two male dovetail bars detachably interlocked with the two dovetail tracks on the U-rod of the suit hanger respectively.

2. The suspension apparatus as claimed in claim 1, wherein the supporting rod has a locking portion, the locking portion formed by bending up the end of the supporting rod.

3. The suspension apparatus as claimed in claim 1, wherein the suit hanger further has a shoulder protection disposed on top of the supporting rod for propping up the lead suit.

* * * * *